US008016994B2

(12) United States Patent
Noller

(10) Patent No.: US 8,016,994 B2
(45) Date of Patent: Sep. 13, 2011

(54) ELECTRODIPPING DEVICE

(75) Inventor: Thomas Noller, Stuttgart (DE)

(73) Assignee: Eisenmann Anlagenbau GmbH & Co. KG (DE)

( * ) Notice: Subject to any disclaimer, the term of this patent is extended or adjusted under 35 U.S.C. 154(b) by 728 days.

(21) Appl. No.: 11/997,867

(22) PCT Filed: Jul. 31, 2006

(86) PCT No.: PCT/EP2006/007561

§ 371 (c)(1),
(2), (4) Date: May 13, 2008

(87) PCT Pub. No.: WO2007/017153

PCT Pub. Date: Feb. 15, 2007

(65) Prior Publication Data

US 2008/0271993 A1 Nov. 6, 2008

(30) Foreign Application Priority Data

Aug. 6, 2005 (DE) ..... 10 2005 037 174

(51) Int. Cl.
*C25D 17/08* (2006.01)

(52) U.S. Cl. ..... 204/623

(58) Field of Classification Search ..... 204/623
See application file for complete search history.

(56) References Cited

U.S. PATENT DOCUMENTS 4,824,538 A * 4/1989 Hibino et al. ..... 204/472
5,494,561 A * 2/1996 Darche et al. ..... 204/625

FOREIGN PATENT DOCUMENTS

DE 3005810 A1 8/1981
DE 19942556 A1 3/2001
DE 10326605 A1 1/2005

* cited by examiner

*Primary Examiner* — Luan V Van
(74) *Attorney, Agent, or Firm* — Factor & Lake, Ltd.

(57) ABSTRACT

The invention relates to an electrodipping device comprising, in a known manner, a bath of enamel, and a transport device used, during the continuous method, to dip the workpieces to be coated into the bath of enamel, to move the workpieces through the bath, and remove the same therefrom. Electrodes are arranged in the bath of enamel, along the path of displacement of the workpieces, said electrodes being connected to a voltage source with one pole thereof. The second pole of said voltage source is connected to a contact rail extending along the path of displacement of the workpieces. Each workpiece is provided with a contact device which is in contact with the contact rail. A controllable voltage regulating unit is arranged between each contact device and the corresponding workpiece. A position determination device enables the momentaneous position of each workpiece to be determined. A control system is used to apply a control signal to the corresponding voltage regulating unit in such a way as to maintain each workpiece at a desired voltage in each position of the course thereof through the bath of enamel.

20 Claims, 1 Drawing Sheet

ELECTRODIPPING DEVICE

RELATED APPLICATIONS

This application claims the filing benefit of International Patent Application No. PCT/EP2006/007561, filed Jul. 31, 2006, which claims the filing benefit of Germany Patent Application No. 10 2005 034 174.4 filed Aug. 5, 2005, the contents of which are incorporated herein by reference.

TECHNICAL FIELD

The invention relates to an electro-dip lacquering device with a) a lacquer bath;
b) a conveying device, with which the workpieces to be lacquered can be dipped in a continuous operation into the lacquer bath, moved through this and lifted out again;
c) a voltage source;
d) electrodes arranged in the lacquer bath along the movement path of the workpieces, which electrodes are connected to a first pole of the voltage source;
e) a contact rail, which extends along the movement path of the workpieces and is connected to the second pole of the voltage source;
f) a contact device, which is in contact with the contact rail, for each workpiece;
g) at least one control system, with which the voltage present at each workpiece can be set during its movement through the lacquer bath.

BACKGROUND OF THE INVENTION

In electro-dip lacquering, also termed electrophoretic lacquering, the lacquer components in the lacquer bath are deposited on the workpieces under the influence of an electric field. It has proved advisable not to keep the electric field constant during the passage of the workpieces through the lacquer bath, but to vary it along the movement path, in particular to let it increase with the distance covered. A reason for this measure inter alia is that the lacquer coating building up represents an electrical resistance, which makes the further build-up of the lacquer coating difficult.

The problem thus arises of how the voltage can be changed for each workpiece as it passes through the lacquer bath. In electro-dip lacquering devices of the type named at the beginning, such as described for example in DE 199 42 556 C2, the current is supplied to the workpiece via a contact rail divided into individual sections in the movement direction of the workpieces to be lacquered; the sections are galvanically separated and connected to one pole of a voltage source assigned to each section. The electrodes arranged along the movement path of the workpieces in the lacquer bath are connected to the other pole of the voltage source. It is disadvantageous in this case that it is relatively difficult to track the path of each individual workpiece along the various sections of the contact rail in control terms and to effect the transition of the workpiece from one section to another section without "jump" in potential. Since the charge flowing between electrode and workpiece is used as a measure for the coating thickness applied, it is necessary to "activate" the measurement of the current flowing to the workpiece section-wise too with the movement of the workpiece. After all, the "cuts" in the contact rails which cause the galvanic separation also represent unevennesses in the contact rail which lead to wear of the contact devices that are moved together with the workpieces.

In the event of changes in the workpiece, e.g. in the length of the workpiece, or in the event of a change in the dipping curve, the positions of the cuts between the contact rail sections change, so that an installation change is necessary for an optimum coating.

The present invention is directed to resolving these and other matters.

SUMMARY OF THE INVENTION

The object of the present invention is to configure an electro-dip lacquering device of the type named at the beginning in such a way that it can be controlled more easily, is flexible, and causes less wear on the contact devices.

This object may be achieved according to the invention in that h) the contact rail is uninterrupted over its entire extension through the lacquer bath;
i) a controllable voltage adjusting unit is arranged between each contact device and the related workpiece;
j) a position indicating device is provided, which determines the momentary position of each workpiece and emits a corresponding signal to the control system;
k) the at least one control system is designed so that from the signal supplied to it by the position indicating device, it determines for each workpiece a voltage at which the workpiece is to be at this position, and it emits a corresponding control signal to the voltage adjusting unit of the corresponding workpiece.

According to the invention, therefore, the division of the contact rail into sections, which is associated with rail cuts, is dispensed with and a galvanically continuous contact rail is used. In order now to be able to apply different potentials, and even potentials that change in the course of the movement, to the various workpieces, which all draw their voltage from the same contact rail, a separate voltage adjusting unit is assigned to each workpiece. This is activated according to the position of the workpiece such that the workpiece is always at the desired potential. In this way a very much more sensitive adjustment of the potentials at the workpieces can be accomplished than in the case of the known division of the contact rail into individual sections. A changeover to a different type of workpieces is possible without any problems solely by means of programming measures. The absence of cuts in the contact rail has a favourable effect on the lifetime of the contact devices.

The at least one control system can be the central control system of the device. This is possible in particular where the conveying device comprises a chain conveyor and all workpieces move at the same velocity.

Modern devices have conveying systems with independently moving carriages each carrying at least one workpiece. Since these carriages are themselves generally "intelligent", thus have a decentralised control system, this can also be used for the purposes according to the invention.

In a particularly preferred embodiment of the invention, the position indicating device has a position code rail as well as a reading head for each workpiece, which head is moved together with the workpiece and is able to read the local code of the position code rail. Position code rails suitable for this are obtainable relatively cheaply in the trade and have a high level of accuracy.

Alternatively a navigating system, for example a laser-controlled or GPS-based system, can be used as a position indicating device.

Furthermore, it is also possible for the position indicating device to comprise a presence sensor at the start of the movement path of the workpieces through the lacquer bath and velocity sensors for the workpieces, wherein the control system is designed so that it can calculate the momentary position for each workpiece from the velocities recorded and the time that has elapsed since the response of the presence sensor.

Instead of the velocity and the time that has elapsed since the presence sensor was passed, the distance covered can also be recorded directly and the momentary position of each workpiece calculated from this. In conveying systems operating with a transport chain, the distance measurement can take place by counting the chain links that have run past, while in the case of conveying systems operating with wheels, by counting the revolutions of the wheels.

It is to be understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
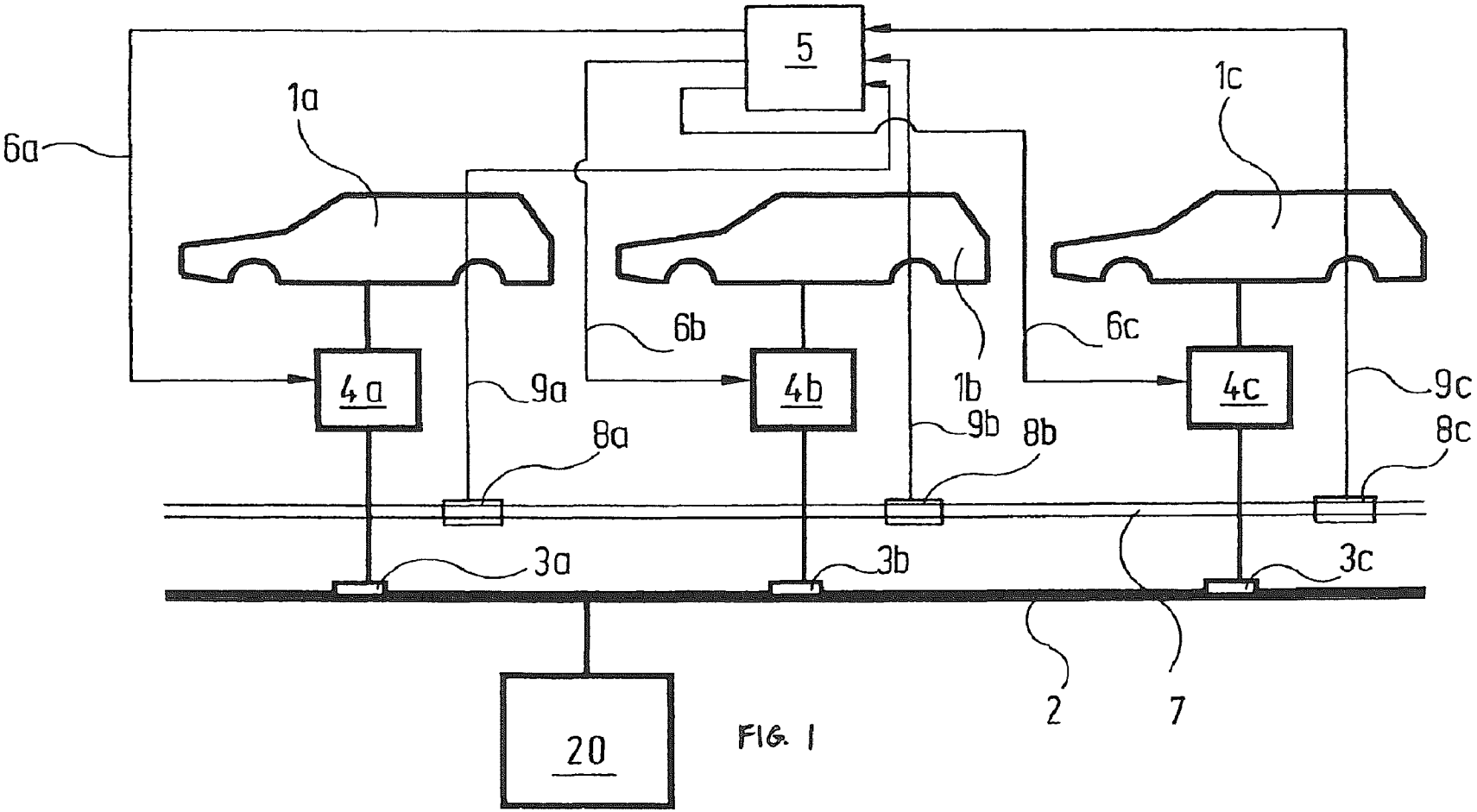
FIG. 1 depicts one embodiment of the present invention.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

An embodiment of the invention is explained in greater detail below with reference to the drawing; the single FIGURE shows schematically the voltage supply of vehicle bodies in an electro-dip lacquering bath.

The drawing shows three vehicle bodies 1*a*, 1*b*, 1*c* in all, which can be thought of as dipped into a lacquer pool filled with lacquering liquid, as described in DE 199 42 556 C2 already mentioned above. The lacquer pool is not shown in FIG. 1, nor is the conveying device with which the various vehicle bodies 1*a*, 1*b*, 1*c* are moved continuously or intermittently through the lacquer pool. A suspension conveyor, such as is shown as a conveying device 12 in DE 199 42 556 C2, a chain conveyor, on which the workpieces are mounted movably, or also a conveying device which makes use of individual, independently movable and controllable carriages, are possible for example.

In the lacquer pool (not shown), counter electrodes, in particular anodes, are positioned in a known manner along the movement path of the vehicle bodies 1*a*, 1*b*, 1*c*, as is likewise to be inferred from DE 199 42 556 C2. In the electric field created within the lacquering liquid between the counter electrodes and the vehicle bodies 1*a*, 1*b*, 1*c*, the deposition of the lacquer components onto the vehicle bodies 1*a*, 1*b*, 1*c* takes place. The ampere hour number that has flowed between the counter electrodes and the vehicle bodies 1*a*, 1*b*, 1*c* on the passage through the lacquer pool represents a direct measurement of the thickness of the lacquer coat deposited.

In order to produce the electric field required for the electrophoretic deposition of the lacquer, the vehicle bodies 1*a*, 1*b*, 1*c* must be connected during their movement through the lacquer bath to the corresponding pole of a direct voltage source 20, in the current case of cataphoretic dip lacquering to its negative pole.

This connection is made in the following manner:

Along the movement path of the vehicle bodies 1*a*, 1*b*, 1*c* leading through the lacquer pool, but outside the lacquering liquid, a contact rail 2 extends. This contact rail 2 is uninterrupted over its entire length, thus does not have the "cuts" customary in the prior art, i.e. points at which different sections of the contact rail are attached, electrically insulated, to one another. The contact rail 2 is connected to a pole, preferably the negative pole, of the direct voltage source 20. It generally suffices if the direct voltage source 20 emits a constant output voltage, which corresponds to the maximum voltage to be applied to the vehicle bodies 1*a*, 1*b*, 1*c*. The other pole of the direct voltage source 20 is connected to the electrodes, preferably anodes, arranged along the movement path.

Each vehicle body 1*a*, 1*b*, 1*c* has a contact shoe 3*a*, 3*b*, 3*c* assigned to it, which shoe, creating an electrical connection, slides along the contact rail 2. The contact shoes 3*a*, 3*b*, 3*c* are not connected directly to the respective vehicle bodies 1*a*, 1*b*, 1*c*, but via a controllable voltage adjusting unit 4*a*, 4*b*, 4*c*. The voltage adjusting units 4*a*, 4*b*, 4*c* are formed so that according to a control signal supplied to them by a control system 5 via a line 6*a*, 6*b*, 6*c*, they can route the voltage present on the contact rail 2 in unchanged or changed, generally reduced, form to the corresponding vehicle body 1*a*, 1*b*, 1*c*.

Running in parallel to the contact rail 2, likewise outside the lacquering liquid, is a position code rail 7. This carries along its longitudinal extension at all points a readable code, which denotes the position of the point in question. Each vehicle body 1*a*, 1*b*, 1*c* has a reading head 8*a*, 8*b*, 8*c* assigned to it which is able to read the momentary position of the corresponding vehicle body 1*a*, 1*b*, 1*c* from the position code rail 7. The signals read by the reading heads 8*a*, 8*b*, 8*c* are supplied via a line 9*a*, 9*b*, 9*c* respectively to the control system 5.

The control system 5 contains a memory in which it is stored in a suitable manner for each vehicle body 1*a*, 1*b*, 1*c*, or at any rate for each type of vehicle body 1*a*, 1*b*, 1*c* that is to be treated on the device, which voltage is to be applied at which point along the movement path to the vehicle body 1*a*, 1*b*, 1*c* in question.

The electro-dip lacquering device described above operates as follows:

As soon as one of the vehicle bodies 1*a*, 1*b*, 1*c* reaches the area of the contact rail 2 and thus the area of the lacquer pool, an electrical connection is made with the contact rail 2 with the aid of the contact shoe 3*a*, 3*b*, 3*c*; the respective reading head 8*a*, 8*b*, 8*c* enters the vicinity of the position coding rail 7 and detects the momentary position of the vehicle body 1*a*, 1*b*, 1*c*. The appropriate information is now emitted to the control system 5, which reads from its memory the desired voltage that is to prevail at the vehicle body 1*a*, 1*b*, 1*c* in question at the respective point. The control system 5 now emits a corresponding signal to the corresponding voltage regulating unit 4*a*, 4*b*, 4*c* via the line 6*a*, 6*b*, 6*c*, which signal ensures that the voltage adjusting unit 4 actually produces the desired voltage from the voltage prevailing on the contact rail 2 and applies it to the vehicle body 1*a*, 1*b*, 1*c*.

This process is repeated constantly during the passage of the vehicle body 1*a*, 1*b*, 1*c* through the lacquer pool. The reading head 8*a*, 8*b*, 8*c* here transmits the respective position either continuously or through small path increments following transit and the control system 5 readjusts the voltage present at the related vehicle body 1*a*, 1*b*, 1*c* via the voltage adjusting units 4*a*, 4*b*, 4*c*.

Obviously it is possible in this way to set a very precise voltage characteristic for all vehicle bodies 1*a*, 1*b*, 1*c* which are connected to the same contact rail 2 during their travel through the lacquer pool.

The positioning device, which was formed in the embodiment described above by the position code rail 7 and the reading heads 8*a*, 8*b*, 8*c*, can naturally also be replaced by other position indicating devices. For example, a navigating system based on a laser control system or on GPS can be used.

In the simplest case a sensor can even be arranged at the entrance to the movement passage through the lacquer pool, which sensor reports the entry of a vehicle body. From there the respective position of the vehicle body is calculated from its velocity, which is ascertained and monitored continuously, and the elapsed time.

Instead of a central control system, decentralised control systems can also be used, which are assigned to the individual vehicle bodies and move together with these.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An electro-dip lacquering device with a) a lacquer bath;

b) a conveying device, with which the workpieces to be lacquered can be dipped in a continuous operation into the lacquer bath, moved through this and lifted out again;

c) a voltage source;

d) electrodes arranged in the lacquer bath along the movement path of the workpieces, which electrodes are connected to a first pole of the voltage source;

e) a contact rail, which extends along the movement path of the workpieces and is connected to the second pole of the voltage source;

f) a contact device, which is in contact with the contact rail, for each workpiece;

g) at least one control system, with which the voltage present at each workpiece can be set during its movement through the lacquer bath; wherein h) the contact rail is uninterrupted over its entire extension through the lacquer bath;

i) arranged between each contact device and the related workpiece is a controllable voltage adjusting unit;

j) a position indicating device is provided, which determines the momentary position of each workpiece and emits a corresponding signal to the at least control system;

k) the at least control system is designed so that from the signal supplied to it by the position indicating device it determines for each workpiece a voltage at which the workpiece is to be at this position, and emits a corresponding control signal to the voltage adjusting unit of the corresponding workpiece.

2. The electro-dip lacquering device of claim 1, wherein the at least one control system is the central control system of the device.

3. The electro-dip lacquering device of claim 1, wherein for each workpiece a decentrilized control system is provided, which moves together with the workpiece.

4. The electro-dip lacquering device of claim 1, wherein the position indicating device has a position code rail as well as for each workpiece a reading head, which is moved together with the workpiece and is able to read the local code of the position code rail.

5. The electro-dip lacquering device of claim 1, wherein the position indicating device is a navigating system.

6. The electro-dip lacquering device of claim 5, wherein the position indicating device is a laser-controlled system.

7. The electro-dip lacquering device of claim 5, wherein the position indicating device is a GPS-based system.

8. The electro-dip lacquering device of claim 1 the position indicating device comprises a presence sensor at the start of the movement path of the workpieces through the lacquer bath and velocity sensors for each workpiece, wherein the control system is designed so that it can calculate the momentary position for each workpiece from the velocities recorded and the time that has elapsed since the response of the presence sensor.

9. The electro-dip lacquering device of claim 1, wherein the position indicating device comprises a presence sensor at the start of the movement path of the workpieces through the lacquer bath and for each workpiece a device for recording the distance covered, wherein the control system is designed so that it can calculate the momentary position for each workpiece from the distances recorded since the response of the presence sensor.

10. The electro-dip lacquering device of claim 8, wherein the conveying device comprises a transport chain and that the device for recording the distance covered has a counting device for the links of the transport chain that are moving past.

11. The electro-dip lacquering device of claim 8, wherein the conveying device for each workpiece comprises at least one revolving wheel and that the device for recording the distance covered has a counting device for the number of revolutions of the wheel.

12. Electro-dip lacquering device of claim 2, wherein the position indicating device has a position code rail as well as for each workpiece a reading head, which is moved together with the workpiece and is able to read the local code of the position code rail.

13. Electro-dip lacquering device of claim 3, wherein the position indicating device has a position code rail as well as for each workpiece a reading head, which is moved together with the workpiece and is able to read the local code of the position code rail.

14. Electro-dip lacquering device of claim 2, wherein the position indicating device is a navigating system.

15. Electro-dip lacquering device of claim 14, wherein the position indicating device is a laser-controlled system.

16. Electro-dip lacquering device of claim 14, wherein the position indicating device is a GPS-based system.

17. Electro-dip lacquering device of claim 3, wherein the position indicating device is a navigating system.

18. Electro-dip lacquering device of claim 17, wherein the position indicating device is a laser-controlled system.

19. Electro-dip lacquering device of claim 17, wherein the position indicating device is a GPS-based system.

20. Electro-dip lacquering device of claim 2, wherein the position indicating device comprises a presence sensor at the start of the movement path of the workpieces through the lacquer bath and velocity sensors for each workpiece, wherein the control system is designed so that it can calculate the momentary position for each workpiece from the velocities recorded and the time that has elapsed since the response of the presence sensor.

* * * * *